US009318881B2

(12) United States Patent
Burrows et al.

(10) Patent No.: US 9,318,881 B2
(45) Date of Patent: Apr. 19, 2016

(54) INTER-EVENT CONTROL STRATEGY FOR CORONA IGNITION SYSTEMS

(71) Applicant: Federal-Mogul Ignition Company, Southfield, MI (US)

(72) Inventors: John Antony Burrows, Cheshire (GB); John E. Miller, Temperance, MI (US); Kristapher I. Mixell, Plymouth, MI (US); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 198 days.

(21) Appl. No.: 14/138,249

(22) Filed: Dec. 23, 2013

(65) Prior Publication Data

US 2014/0182538 A1 Jul. 3, 2014

Related U.S. Application Data

(60) Provisional application No. 61/740,781, filed on Dec. 21, 2012, provisional application No. 61/740,796, filed on Dec. 21, 2012.

(51) Int. Cl.

| | |
|---|---|
| ***F02P 23/00*** | (2006.01) |
| ***H01T 19/00*** | (2006.01) |
| ***F02P 19/02*** | (2006.01) |
| ***F02P 23/04*** | (2006.01) |

(52) U.S. Cl.

CPC ..... *H01T 19/00* (2013.01); *F02P 19/02* (2013.01); *F02P 23/04* (2013.01)

(58) Field of Classification Search

CPC ..... F02P 23/04; F02P 2041/288

USPC ..... 123/143 R, 143 B; 701/102, 113; 324/600, 633, 678

See application file for complete search history.

(56) References Cited

U.S. PATENT DOCUMENTS

| | | | |
|---|---|---|---|
| 4,996,967 | A | 3/1991 | Rosswurm et al. |
| 5,568,801 | A | 10/1996 | Paterson et al. |

(Continued)

FOREIGN PATENT DOCUMENTS

DE 102010044845 B3 12/2011

OTHER PUBLICATIONS

International Search Report mailed on Feb. 26, 2014 (PCT/US2013/077365).

*Primary Examiner* — John Kwon

(74) *Attorney, Agent, or Firm* — Robert L. Stearns; Dickinson Wright, PLLC

(57) ABSTRACT

The invention provides a system and method for controlling corona discharge. A driver circuit provides energy to the corona igniter and detects any arc formation. Optionally, in response to each arc formation, the energy provided to the corona igniter is shut off for a short time to dissipate the arc. Once the arc dissipates, the energy is applied again to restore the corona discharge. The driver circuit obtains information relating to the corona discharge, such as timing and number of arc formations. A control unit adjusts the energy provided to the corona igniter, shut-off time, or the duration of the corona event based on the information. The adjusted energy levels and duration are applied during subsequent corona events. For example, the voltage level could be reduced or the shutoff time could be increased to limit arc formations and increase the size of the corona discharge during the subsequent corona events.

10 Claims, 9 Drawing Sheets

(56) References Cited

U.S. PATENT DOCUMENTS

| | | | | |
|---|---|---|---|---|
| 5,649,507 | A | 7/1997 | Gregoire et al. | |
| 6,085,733 | A | 7/2000 | Motoyama et al. | |
| 6,883,507 | B2 | 4/2005 | Freen | |
| 7,644,698 | B2 | 1/2010 | Shiraishi et al. | |
| 7,721,697 | B2 | 5/2010 | Smith et al. | |
| 2010/0147239 | A1 | 6/2010 | Lu et al. | |
| 2010/0251995 | A1 | 10/2010 | Nouvel et al. | |
| 2011/0114071 | A1 | 5/2011 | Freen | |
| 2011/0197865 | A1 | 8/2011 | Hampton | |
| 2011/0297132 | A1 | 12/2011 | Schremmer et al. | |
| 2011/0305998 | A1 | 12/2011 | Toedter et al. | |
| 2012/0048225 | A1 | 3/2012 | Makarov et al. | |
| 2012/0055455 | A1 | 3/2012 | Ruan et al. | |
| 2012/0063054 | A1 | 3/2012 | Burrows et al. | |
| 2012/0145136 | A1 | 6/2012 | Burrows et al. | |
| 2012/0180742 | A1* | 7/2012 | Burrows | F02P 9/007 123/143 B |
| 2012/0192825 | A1 | 8/2012 | Trump | |
| 2012/0249006 | A1 | 10/2012 | Burrows | |
| 2012/0249163 | A1* | 10/2012 | Burrows | F02P 23/04 324/633 |
| 2012/0260898 | A1 | 10/2012 | Schremmer | |
| 2014/0174392 | A1* | 6/2014 | Burrows | F02P 23/04 123/143 B |
| 2015/0171602 | A1* | 6/2015 | Burrows | G01M 15/02 361/230 |

* cited by examiner

INTER-EVENT CONTROL STRATEGY FOR CORONA IGNITION SYSTEMS

CROSS REFERENCE TO RELATED APPLICATIONS

This U.S. utility patent application claims the benefit of U.S. provisional patent application No. 61/740,781, filed Dec. 21, 2012, and U.S. provisional patent application No. 61/740,796, filed Dec. 21, 2012, the entire contents of which are incorporated herein by reference in their entirety.

BACKGROUND OF THE INVENTION

1. Field of the Invention

This invention relates generally to a corona ignition system, and a method of controlling corona discharge and arc formation provided by the corona ignition system.

2. Related Art

Corona discharge ignition systems provide an alternating voltage and current, reversing high and low potential electrodes in rapid succession. These systems include a corona igniter with an electrode charged to a high radio frequency voltage potential and creating a strong radio frequency electric field in a combustion chamber. The electric field causes a portion of a mixture of fuel and air in the combustion chamber to ionize and begin dielectric breakdown, facilitating combustion of the fuel-air mixture. During typical operation of the corona ignition system, the electric field is ideally controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. The corona discharge has a low current and can provide a robust ignition without requiring a high amount of energy and without causing significant wear to physical components of the ignition system.

In a corona ignition system, good ignition characteristics are due to the corona discharge spreading over a large volume in a large number of filaments or streamers. If too much energy is applied to the corona igniter, it is possible for the corona discharge to extend from the high voltage source far enough to reach a grounded engine component. When this happens, a conductive path, referred to as an arc, is formed to the grounded component. The arc formation comprises a relatively high current flow and thus concentrates the ignition energy into a very limited volume, reducing ignition efficiency. It is typically desirable to avoid this situation. Conversely, it is difficult to be certain that a corona igniter is fed with enough energy to produce a large enough corona, as there is no direct method of obtaining the volume of the corona discharge.

SUMMARY OF THE INVENTION

One aspect of the invention provides a corona ignition system for controlling volume and duration of corona discharge on an inter-event basis. The system includes a corona igniter receiving energy and providing corona discharge during a plurality of corona events. Each corona event comprises a duration of time extending continuously from a start time to a stop time.

A driver circuit provides the energy to the corona igniter during the corona events, and the energy includes at least one of a predetermined voltage level and a predetermined current level. The driver circuit also obtains information relating to the corona discharge of at least one of the corona events. This information includes at least one of: timing of an occurrence of the arc formation relative to the start time of the corona event, duration between two consecutive occurrences of the arc formations, number of occurrences of the arc formations over a period of time during the corona event, timing of an occurrence of the arc formation relative to the stop time of the corona event, total number of occurrences of the arc formations during the corona event, and at least one of the voltage level and the current level provided to the corona igniter at the stop time of the corona event.

A control unit receives the information relating to the corona discharge from the driver circuit, and adjusts at least one of the stored predetermined voltage level and the predetermined current level based on the information relating to the corona discharge. The driver circuit then applies at least one of the adjusted predetermined voltage level and the adjusted predetermined current level to the corona igniter during at least one subsequent corona event. The adjusted levels are not provided before the stop time of the at least one corona event from which the information was obtained.

Another aspect of the invention provides a corona ignition system wherein the driver circuit detects any occurrence of an arc formation and provides no energy to the corona igniter for a duration of time immediately after any occurrence of the arc formation. The duration of time wherein no energy is provided to the corona igniter is predetermined, and the control unit adjusts this predetermined duration of time based on the information relating to the corona discharge. The driver circuit then applies the adjusted predetermined duration of time to at least one subsequent corona event. The adjusted duration is not applied before the stop time of the at least one corona event from which the information was obtained.

Yet another aspect of the invention provides a corona ignition system wherein the duration of the corona event is predetermined, and the control unit adjusts the predetermined duration of the corona event based on the information relating to the corona discharge. The adjusted duration of the corona event is not applied before the stop time of the at least one corona event from which the information was obtained.

Another aspect of the invention provides a method of controlling a corona ignition system on an inter-event basis. The method comprises providing energy to a corona igniter during a plurality of corona events, wherein the energy includes at least one of a predetermined voltage level and a predetermined current level, and each corona event includes a continuous duration of time extending from a start time to a stop time. The method also includes obtaining information relating to the corona discharge of at least one of the corona events; and adjusting at least one of the predetermined voltage level and the predetermined current level based on the information relating to the corona discharge. The method next includes applying at least one of the adjusted predetermined voltage level and the adjusted predetermined current level to the corona igniter during at least one subsequent corona event and not before the stop time of the at least one corona event from which the information was obtained.

Yet another aspect of the invention provides a method of controlling a corona ignition system on an inter-event basis, wherein including the step of detecting any occurrence of an arc formation, and providing no energy to the corona igniter for a duration of time immediately after any occurrence of the arc formation. The duration of time wherein no energy is provided to the corona igniter after each occurrence of the arc formation is predetermined. The method further includes adjusting the predetermined duration of time wherein no energy is provided to the corona igniter based on the information relating to the corona discharge; and applying the adjusted predetermined duration of time in at least one subsequent corona event and not before the stop time of the at least one corona event from which the information was obtained.

Another aspect of the invention provides a method of controlling a corona ignition system on an inter-event basis, wherein the duration of the corona event extending from the start time to the stop time is predetermined. The method includes adjusting the duration of the corona event based on the information relating to the corona discharge; and applying the adjusted duration of time to at least one subsequent corona event and not before the stop time of the at least one corona event from which the information was obtained.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
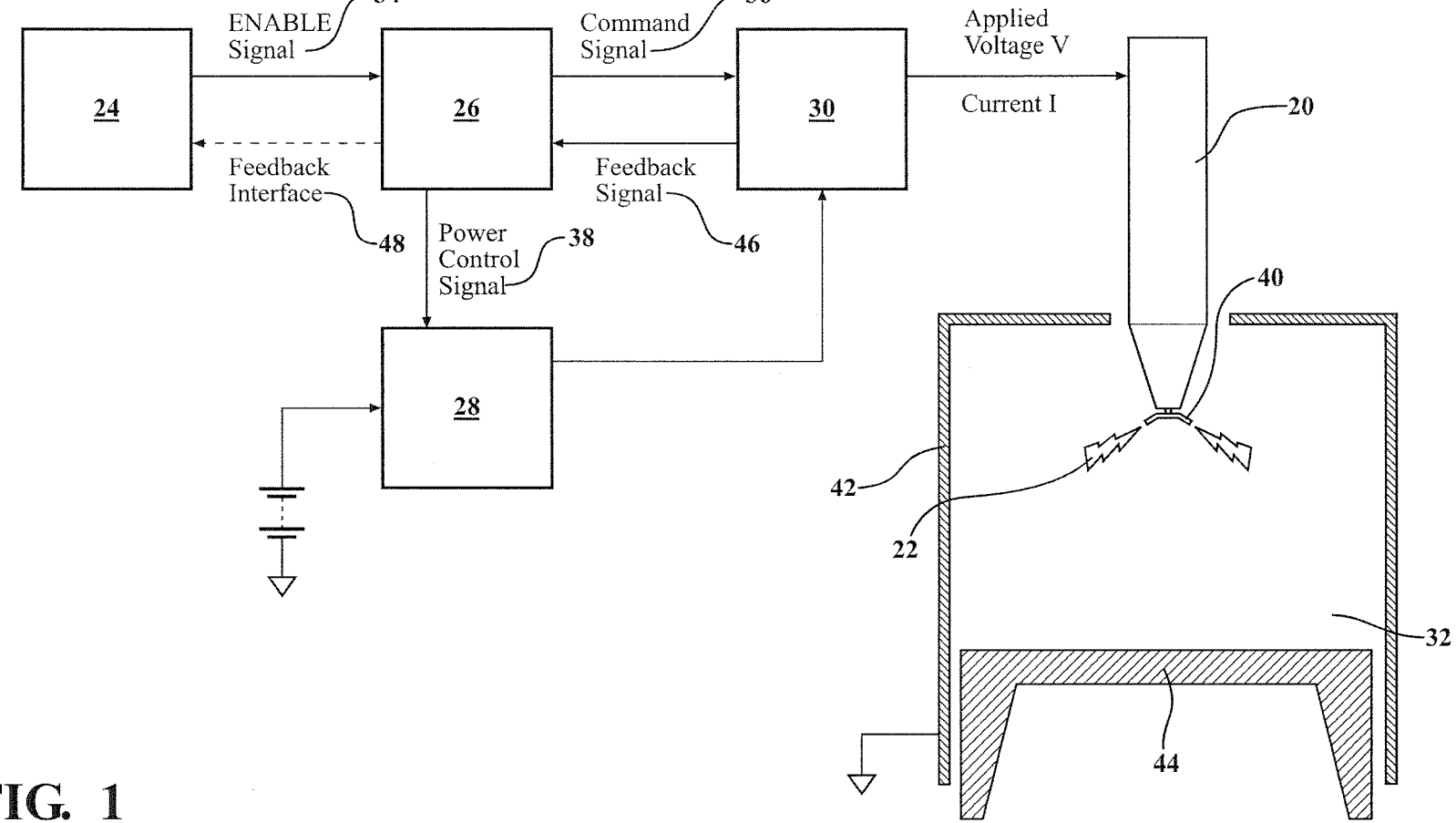
FIG. 1 is a block diagram showing hardware of a corona ignition system for controlling corona discharge and arc formation according to one embodiment of the invention.

One aspect of the invention provides a corona ignition system for an internal combustion engine. The system includes a corona igniter 20 providing corona discharge 22, an engine control system 24, a control unit 26, a power supply 28, and a driver circuit 30. An exemplary system is generally shown in FIG. 1. The system uses information relating to the corona discharge 22 of one or more corona events to adjust the energy levels of subsequent corona events, or to adjust the duration of subsequent corona events, in order provide the maximum possible volume of corona discharge 22 under all operation conditions. The system can be made stable for all operating conditions, including those where breakdown of the corona discharge 22 to arc formation is unavoidable.

In the exemplary system, the engine control system 24 initiates the start of a corona event in order to ignite a mixture of fuel and air in a combustion chamber 32 of the internal combustion engine. Each corona event is a single continuous duration of time extending from a start time to a stop time, during which the corona igniter 20 receives energy and provides the corona discharge 22. The control unit 26 typically reads the predetermined duration of the corona event from a table or map stored in the control unit 26 or the engine control system 24. Initially, the predetermined duration is set as a function of engine parameters or operating conditions in the combustion chamber 32. Typically, the duration of the corona event ranges from 20 to 3,500 microseconds. However, the predetermined duration stored in the control unit 26 or engine control system 24 can be adjusted based on information relating to the corona discharge of a previous corona event, in order to enhance the corona discharge 22, which will be discussed further below.

The engine control system 24 starts the corona event at the start time by conveying an enable signal 34 to the control unit 26, which actives the control unit 26. In this example, the engine control system 24 also stops the corona event by conveying a signal to the control unit 26 at the stop time, which deactivates the control unit 26. These steps are repeated for each corona event. In the embodiment of FIG. 1, the engine control system 24 is separate from the control unit 26, but alternatively the engine control system 24 can be combined with the control unit 26 in a single piece of hardware. Furthermore, the other components of the system could also be combined in various different manners.

In response to the enable signal 34, the control unit 26 turns on the driver circuit 30 by conveying a command signal 36 to the driver circuit 30. The control unit 26 also conveys a power control signal 38 to the power supply 28, instructing the power supply 28 to provide the energy to the driver circuit 30, which ultimately reaches the corona igniter 20, at a predetermined voltage level and a predetermined current level. Thus, the control unit 26 controls the energy provided to the corona igniter 20. In the exemplary system, the predetermine voltage level ranges from 100V to 1500V and the predetermined current level ranges from 0.5 to 15 A. Ideally, the corona igniter 20 receives the high radio frequency voltage and current and provides a strong radio frequency electric field, i.e. the corona discharge 22, in the combustion chamber 32. In the system of FIG. 1, the corona igniter 20 includes a firing tip 40 for emitting the corona discharge 22.

The control unit 26 typically reads the predetermined voltage level and the predetermined current level from a table or map stored in the control unit 26 or the engine control system 24. Initially, the predetermined voltage level and the predetermined current level are based on engine parameters or operating conditions in the combustion chamber 32. However, the predetermined levels stored in the control unit 26 or engine control system 24 are adjusted based on information relating to the corona discharge of a previous corona event, in order to enhance the corona discharge 22, which will be discussed further below.

The driver circuit 30 receives the energy from the power supply 28 at the predetermined voltage level and the predetermined current level. In response to the command signal 36 from the control unit 26, the driver circuit 30 provides the energy to the corona igniter 20 at the predetermined voltage level and the predetermined current level. The corona igniter 20 receives the energy from the driver circuit 30, and emits the corona discharge 22. In an ideal situation, the corona discharge 22 would rapidly form in the combustion chamber 32, grow to a maximum volume, which is the largest possible volume without reaching a grounded component, and remain at the maximum volume until the end of the corona event. Thus, the corona discharge 22 would provide a high quality ignition by igniting a large volume of the air-fuel mixture in the combustion chamber 32.

However, at some point during the corona event, the corona igniter 20 typically receives too much energy, causing the corona discharge 22 grow too large and reach a grounded component, such as a wall 42 of the combustion chamber 32 or a piston 44 reciprocating in the combustion chamber 32. At this time, a conductive path, referred to as an arc formation, forms between the corona igniter 20 and the grounded component. In other words, the corona discharge 22 transforms into the arc formation. The corona discharge 22 is preferred over the arc formation because it has a lower current and spreads over a larger volume, and thus is able to provide a higher quality ignition of the fuel-air mixture.

In one embodiment, any occurrence of an arc formation in the combustion chamber 32 is immediately detected by the driver circuit 30. However, an arc formation is not necessarily detected as the corona event can occur without any arc formations. An exemplary method used to detect the onset of any arc formation is described in U.S. patent application Ser. No. 13/438,116. This method does not rely on measuring current, voltage, or impedance parameters related to the corona discharge 22. Rather, the method detects the arc formation by identifying a variation in an oscillation period of the resonant frequency, and provides a positive detection in nanoseconds or microseconds, and typically less than 2 μs. Accordingly, it is an easily implemented method allowing for very rapid feedback indicating the occurrence of arc formation. However, other methods can be used to detect the arc formation.

Figure 2:
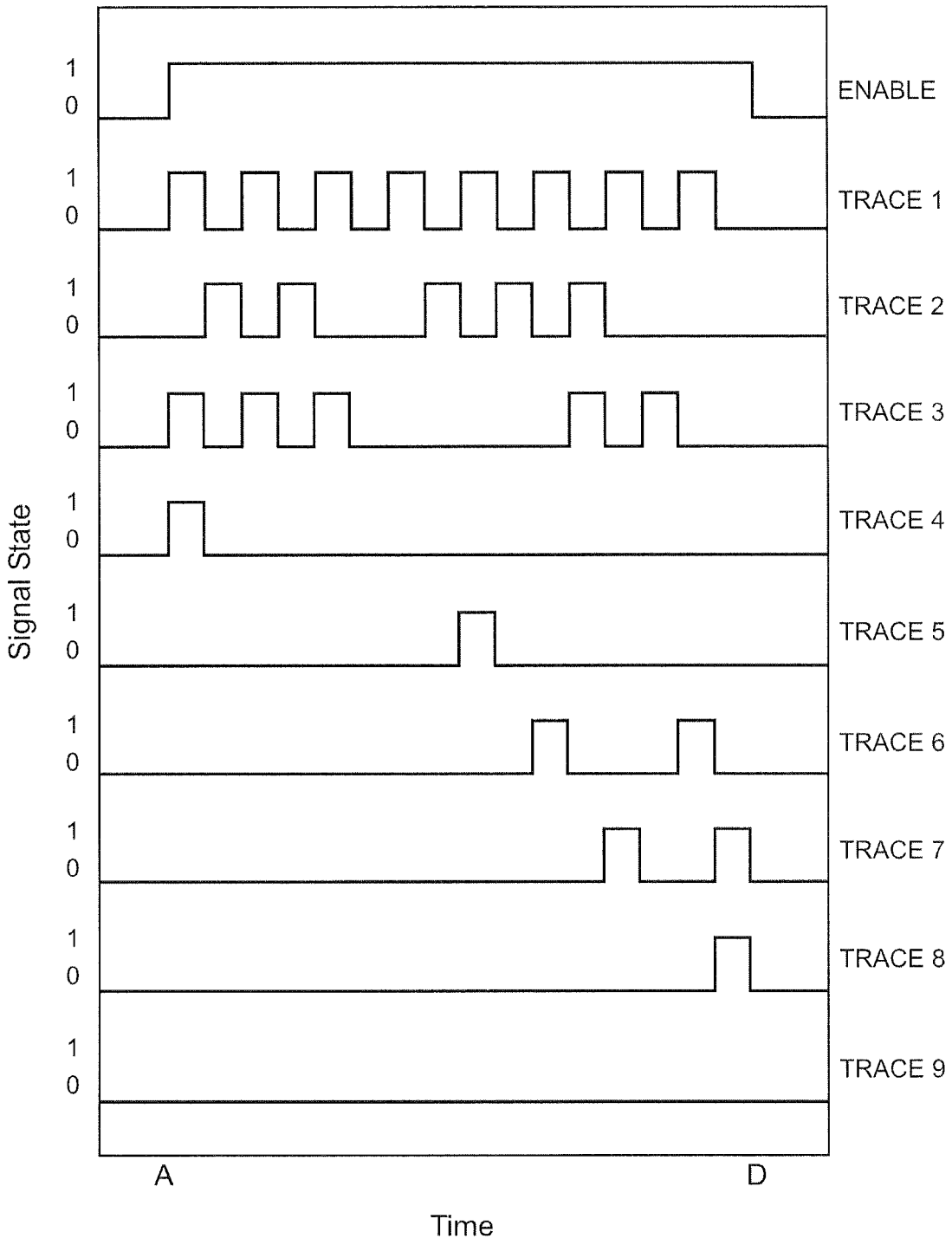
FIG. 2 is a graph illustrating nine exemplary feedback signals indicating the occurrence or absence of at least one arc formation during a single corona event relative to an enable signal starting and stopping the corona event.

When the driver circuit 30 detects any occurrence of the arc formation, the driver circuit 30 conveys a feedback signal 46 to the control unit 26 indicating the occurrence of the arc formation. FIG. 2 is a graph illustrating nine exemplary feedback signals 46 indicating one or multiple arc formations during a single corona event, relative to the enable signal 34 starting and stopping the corona event. In one embodiment, in response to the feedback signal 46, the control unit 26 sends another command signal 36 to the driver circuit 30 instructing the driver circuit 30 to cease the energy provided to the corona igniter 20 for a short duration of time immediately after the occurrence of the arc formation. This duration of time is typically predetermined and stored in the control unit 26. Accordingly, once the arc formation is detected, the driver circuit 30 provides no energy to the corona igniter 20 for the predetermined duration of time, and thus the arc formation dissipates. As an alternative, where engine operating conditions so dictate, the step of providing no energy to the corona igniter 20 for a short duration of time immediately after the occurrence of the arc formation may be omitted and thus the arc formation is allowed to continue until the end of the enable signal.

The control unit 26 typically reads the predetermined duration of time during which no energy is provided to the corona igniter 20 from a table or map stored in the control unit 26 or the engine control system 24. Initially, the predetermined duration of time is based on engine parameters or operating conditions in the combustion chamber 32. In one embodiment, this duration ranges from ten to hundreds of microseconds. However, the predetermined duration of time stored in the control unit 26 or engine control system 24 can be adjusted based on information relating to the corona discharge of a previous corona event, in order to enhance the corona discharge 22, which will be discussed further below.

An exemplary method used to shut off the energy provided to the corona igniter 20 for the short duration of time is described in U.S. patent application Ser. No. 13/438,127. Although nothing is done to prevent the first occurrence of the arc formation, upon the first detection, the system takes action to prevent future arc formations. In the exemplary method, the energy is immediately shut off in response to the arc formation, rather than reduced, because the voltage required to maintain the arc formation is much less than the voltage required to maintain the corona discharge 22, and thus reducing the voltage applied to the corona igniter 20 will most likely not dissipate the arc formation.

After the duration of time wherein no energy is provided to the corona igniter 20 and the arc formation dissipates, the control unit 26 again instructs the driver circuit 30 to provide energy to the corona igniter 20 and restore the corona discharge 22. The energy is provided to the igniter until the arc formation occurs again. The steps of detecting the arc formation, shutting of the energy, and re-applying the energy to the corona igniter 20 can be repeated throughout each corona event. However, as described above, engine conditions may dictate that the step of shutting off the energy after any occurrence of an arc formation is omitted, and the inter-event control system and method otherwise proceeds as described.

Upon detection of the arc formation, the driver circuit 30 obtains information about the arc formation and relating to the corona discharge 22. This information can be obtained either during or after the corona event. The information is more than just a "yes or no" result, and it is used to infer information about the volume and duration of the corona discharge 22. The information relating to the corona discharge 22 includes at least one of the following characteristics: timing of an occurrence of the arc formation relative to the start time of the corona event, duration between two consecutive occurrences of the arc formations, number of occurrences of the arc formations over a period of time during the corona event, timing of an occurrence of the arc formation relative to the stop time of the corona event, total number of occurrences of the arc formations during the corona event, and at least one of the voltage level and the current level provided to the corona igniter 20 at the stop time of the corona event. The driver circuit 30 preferably obtains the information relating to the corona discharge 22 of each corona event. In the case where the step of shutting off the energy supply after detection of arc formation is omitted, the possible information relating to the corona discharge is limited to at least one of the following characteristics: timing of an occurrence of the arc formation relative to the start time of the corona event, timing of an occurrence of the arc formation relative to the stop time of the corona event, and at least one of the voltage level and the current level provided to the corona igniter 20 at the stop time of the corona event.

The driver circuit 30 then conveys the information relating to the corona discharge 22 in the feedback signal 46 to the control unit 26. This can be the same feedback signal 46 sent in response to the detection of the arc formation, or a separate signal. For example one feedback signal 46 indicating the occurrence of arc formation can be sent during the corona event, and another feedback signal 46 including the information relating to the corona discharge 22 can be sent after the corona event. At least one feedback signal 46 is typically sent at the end of the corona event, which includes the timing of an occurrence of the arc formation relative to the stop time of the corona event, total number of occurrences of the arc formations during the corona event, and the voltage level and the current level provided to the corona igniter 20 at the stop time of the corona event.

Figure 3:
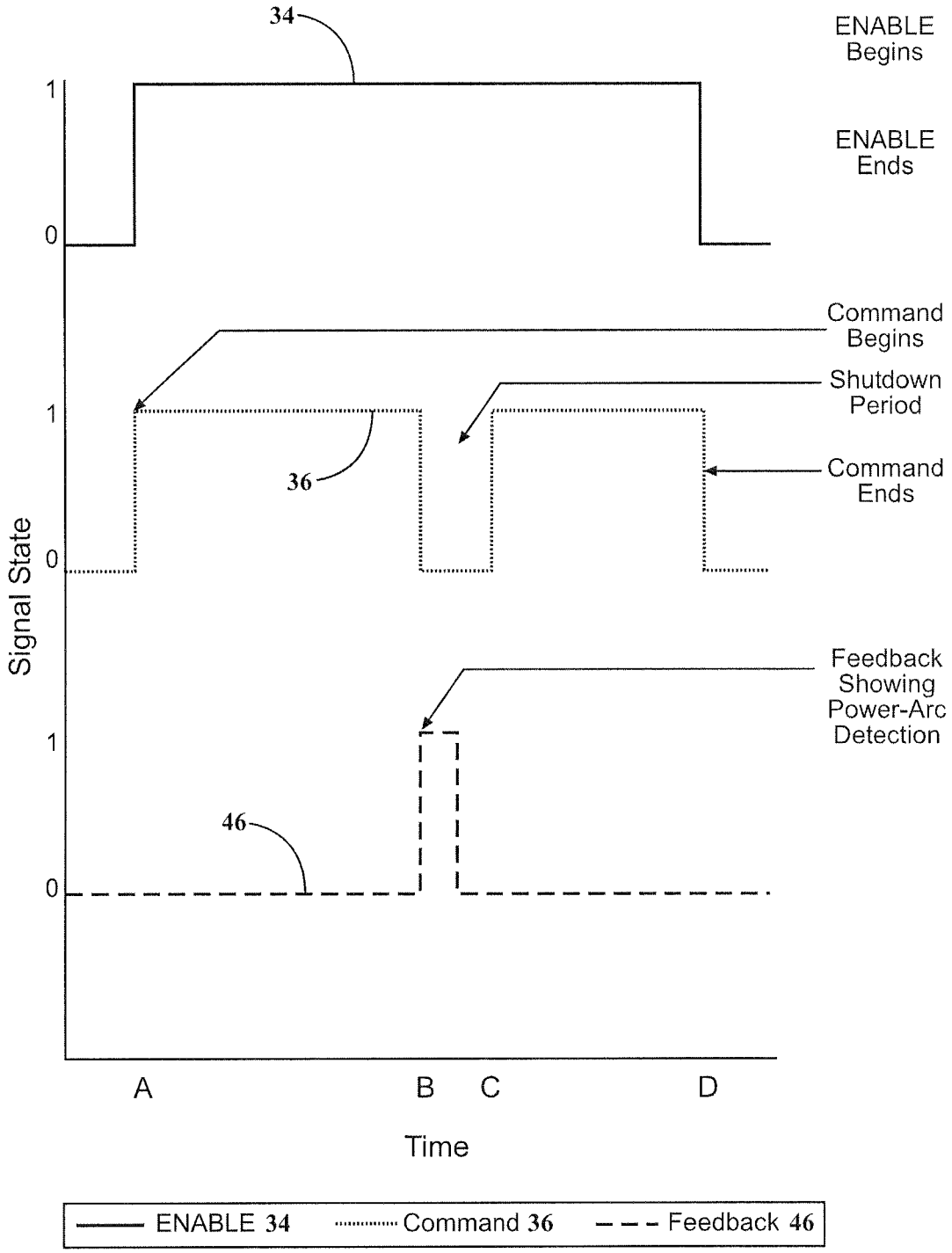
FIG. 3 is a graph illustrating a feedback signal, an enable signal, and a command signal when only one occurrence of arc formation is detected during a corona event.
Figure 4:
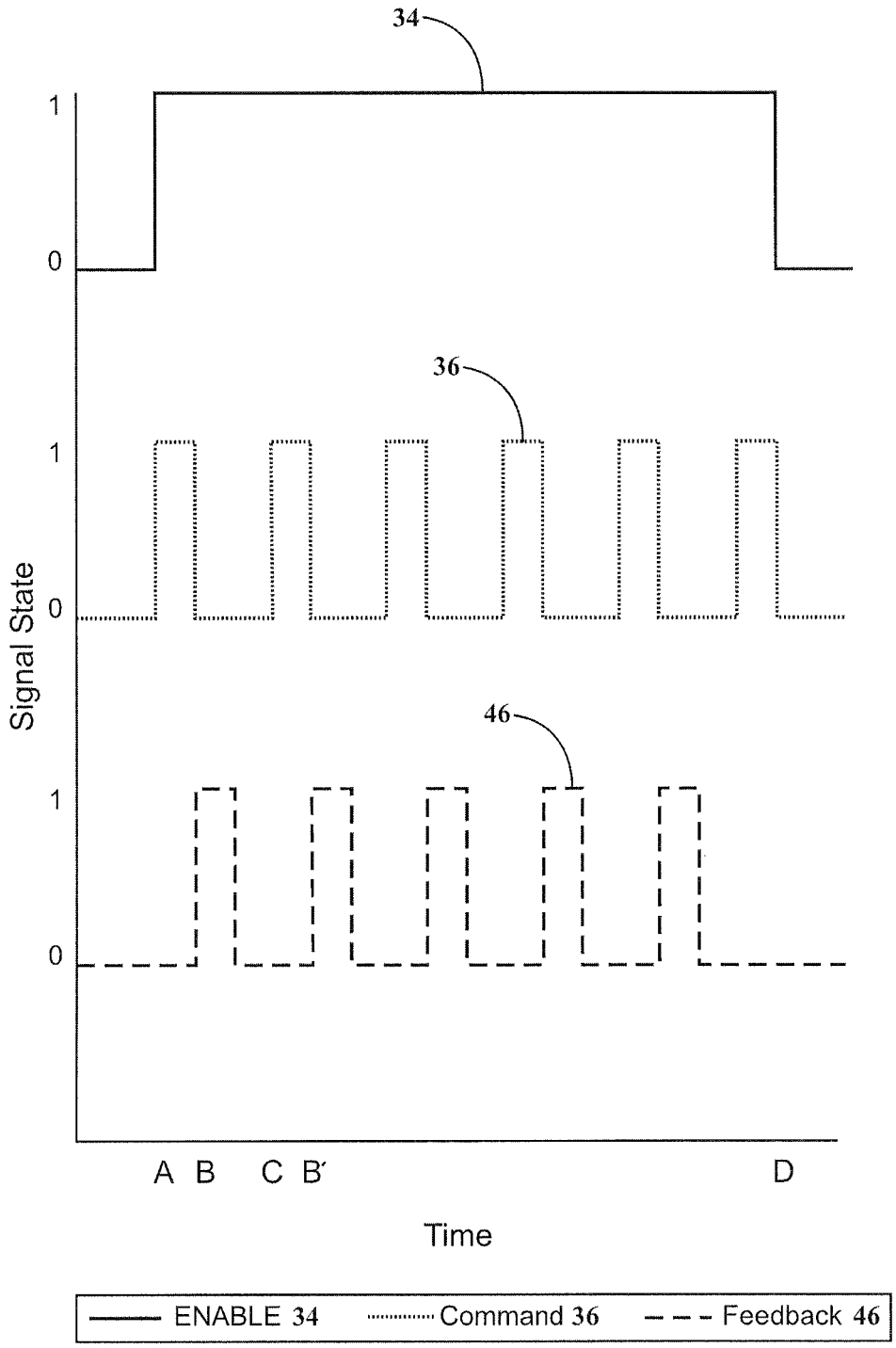
FIG. 4 is a graph illustrating a feedback signal, an enable signal, and a command signal when multiple occurrences of arc formation are detected during a corona event.

FIG. 3 is a graph illustrating the feedback signal 46, the enable signal 34 provided from the engine control system 24 to the control unit 26, and the command signal 36 provided from the control unit 26 to the driver circuit 30 when the corona event includes one occurrence of the arc formation and a shutdown period is employed. FIG. 4 is a graph illustrating the feedback signal 46, enable signal 34, and command signal 36 when multiple arc formations are detected during a single corona event and a shutdown period is employed.

The control unit 26 then uses the information relating to the corona discharge 22, including information about the arc formations, to adjust the predetermined values stored in the tables or maps, which are applied to future corona events, in order to increase the volume and duration of the corona discharge 22 formed in future corona events, i.e. inter-event control. For example, the control unit 26 can use the information relating to the corona discharge 22 of at least one of the corona events to adjust the predetermined voltage and current levels provided to the corona igniter 20 in at least one subsequent corona event. The control unit 26 can also use the information from at least one of the corona events to adjust the predetermined duration of time wherein no energy is provided to the corona igniter 20 in at least one subsequent corona event. The control unit 26 can also use the information from at least one of the corona events to adjust the duration between the start time and the stop time of at least one subsequent corona event. The energy levels or duration of the corona events are adjusted to achieve the maximum volume and duration of the corona discharge 22 in the subsequent corona events.

When the control unit 26 uses the information to determine whether the energy provided to the corona igniter 20 should be increased or decreased, the control unit 26 instructs the power supply 28 to adjust the energy provided to the driver circuit 30, based on the information obtained, and thus reduce the likelihood of arc formations, at least until the very end of the corona event. In other words, in order to enhance the size and/or duration of the corona discharge 22, the control unit 26 conveys the power control signal 38 to the power supply 28 instructing the power supply 28 to adjust the energy provided to the driver circuit 30 and ultimately to the corona igniter 20, based on the information relating to the corona discharge 22. The control unit 26 can also adjust the timing of the command signal 36 to the driver circuit 30, in order to adjust the duration of time during which the driver circuit 30 provides energy or does not provide energy to the corona igniter 20.

Figure 6:
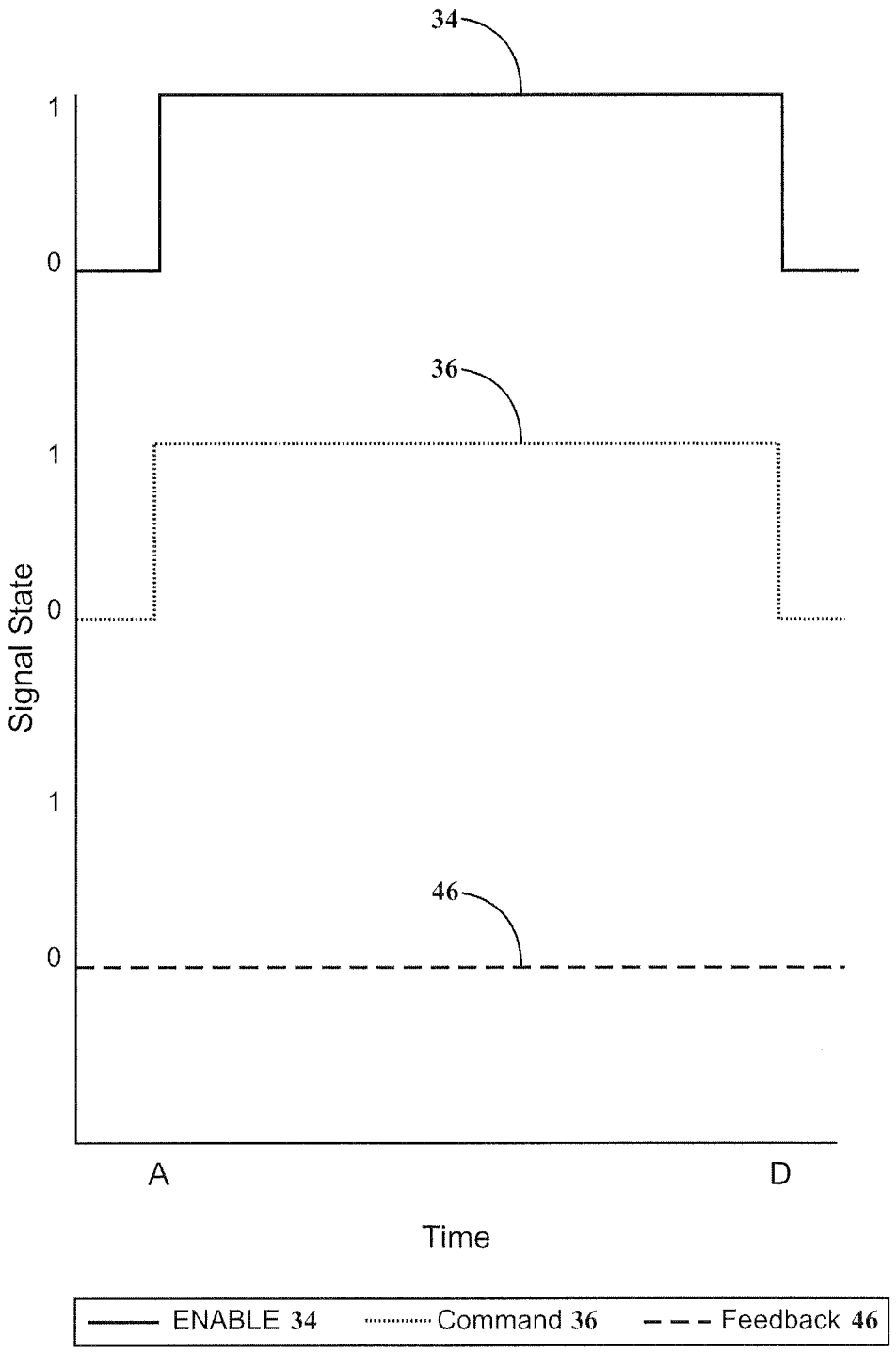
FIG. 6 is a graph illustrating a feedback signal, an enable signal, and a command signal when no arc formation is detected during a corona event.

If the feedback signal 46 to the control unit 26 indicates multiple arc formations occurred early in the corona event, and repeated throughout the corona event, for example traces 1-3 of FIG. 2 and FIG. 4, then the control unit 26 infers that the voltage level provided to the corona igniter 20 is too high and should be reduced during the subsequent corona events. Alternatively, the total duration of the corona event or the duration of time wherein no energy is provided to the corona igniter 20 could be increased. If the feedback signal 46 to the control unit 26 indicates that a single arc formation occurred at the beginning of the corona event, for example trace 4 of FIG. 2, then the control unit 26 again infers that the voltage level provided to the corona igniter 20 is too high and should be reduced during the subsequent corona events. Alternatively, the duration of time wherein no energy is provided to the corona igniter 20 could be increased. If the feedback signal 46 indicates no occurrence of the arc formation, for example trace 9 of FIG. 2 or FIG. 6, then the control unit 26 infers that the voltage level provided to the corona igniter 20 is too low and should be increased in order to increase the volume of corona discharge 22 during the subsequent corona events.

Figure 5:
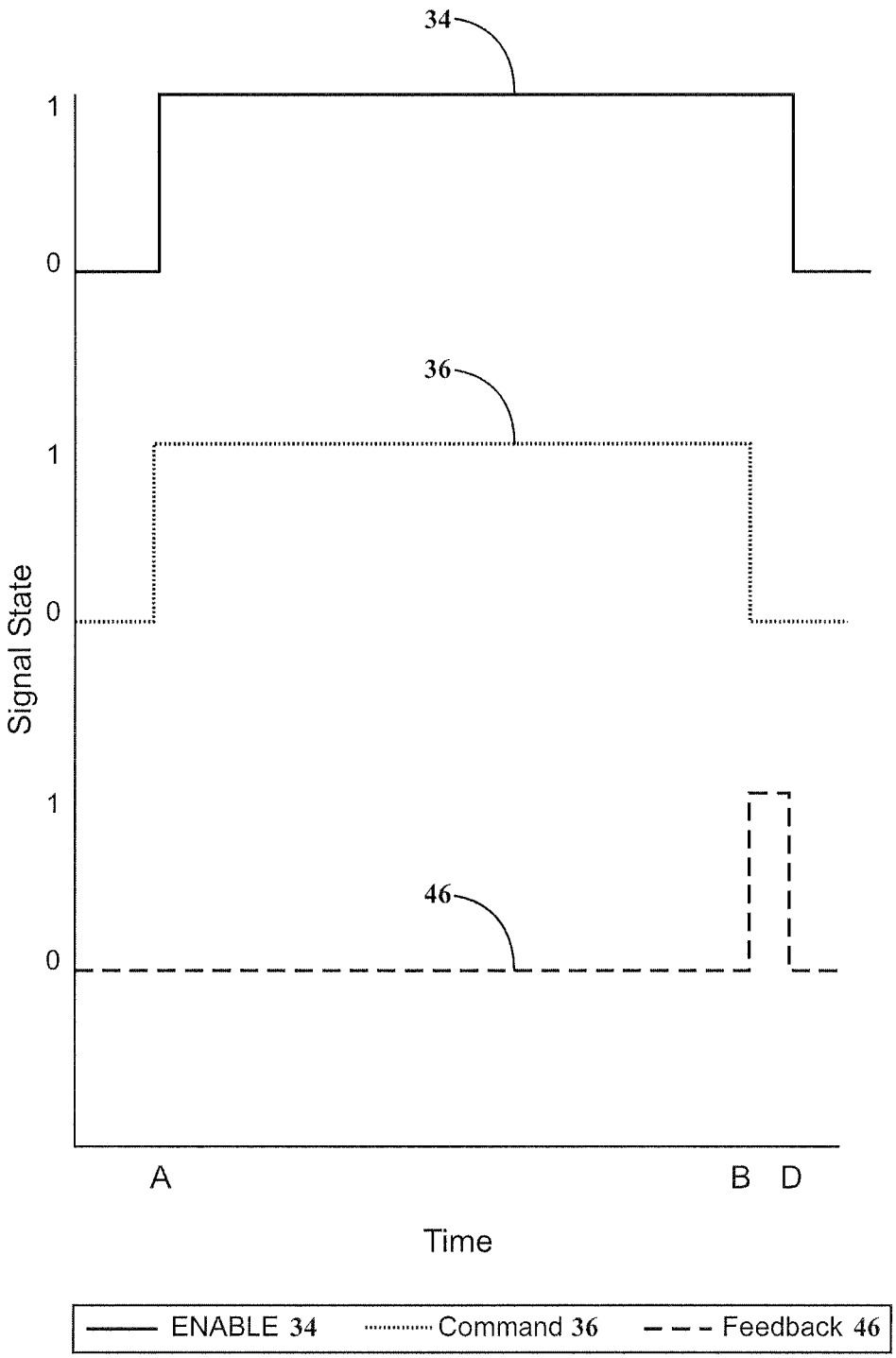
FIG. 5 is a graph illustrating a feedback signal, an enable signal, and a command signal for an ideal situation wherein only one occurrence of an arc formation is detected at the end of a corona event.

In cases where the first occurrence of an arc formation is at the very end of the corona event, for example traces 5-8 of FIG. 2 and FIG. 5, then the control unit 26 infers that the voltage level provided to the corona igniter 20 is in the correct range. In one preferred embodiment, the energy is provided to the corona igniter 20 is at a voltage level and current level causing the corona igniter 20 to provide corona discharge 22 immediately after the start time and continuously for a majority of the duration of the corona event and causing the corona igniter 20 to provide only one occurrence of the arc formation following the corona discharge 22 before the stop time of the corona event. In this case, the command signal 36 instructing the driver circuit 30 to shut off the energy provided to the corona igniter 20 in response to the arc formation may be cut off by the enable signal 34 ending the corona event. In other words, the arc formation occurs immediately prior to a predetermined stop time of the corona event. Trace 8 of FIG. 2 and FIG. 5 illustrate the feedback signal 46 during this ideal situation. In this case, the control unit 26 infers that the corona discharge 22 is at or very close to the maximum possible volume and therefore no adjustments to the energy provided to the corona igniter 20 are needed.

Figure 7:
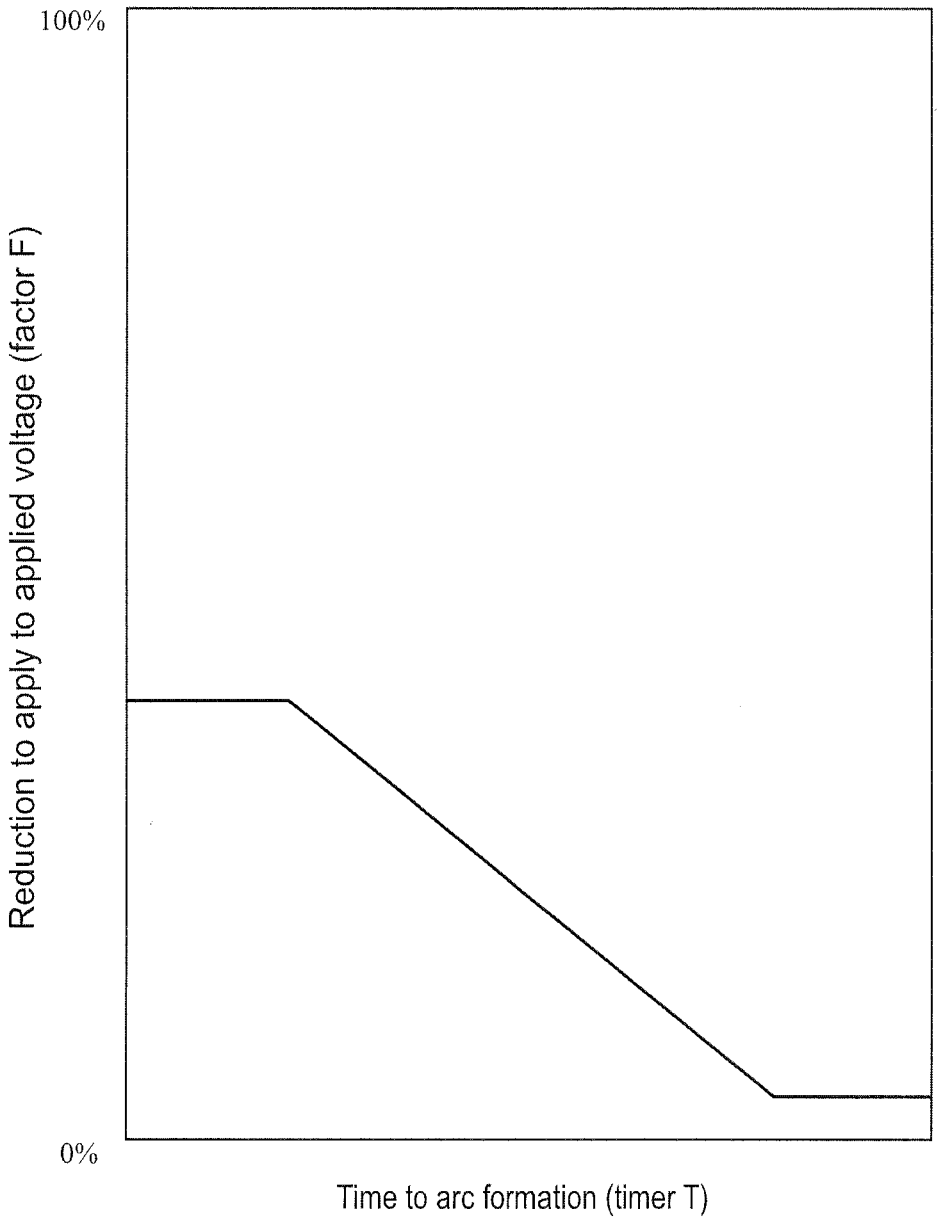
FIG. 7 is a graph illustrating a reduction factor for applying to a voltage level relative to timing of the first occurrence of an arc formation.

Typically, at least one of the voltage level and the current level are adjusted by a factor depending on the information relating to the corona discharge 22. The factor can be based on the information from one of the corona events, or a plurality of the corona events. For example, if the arc formation is detected at or close to the start time of the corona event, or if the duration between consecutive occurrences of the arc formation is short, then the voltage level is reduced by a larger factor than if the arc formation is detected toward the end of the corona event or if only one arc formation is detected. FIG. 7 is a graph illustrating a reduction factor to apply to the voltage level relative to the timing of the first occurrence of an arc formation. If the arc formation is detected in the first half of the corona event, then the factor is greater than if the arc formation is detected in the latter half of the corona event. For cases where there are multiple arc formations in a single corona event, the modifications to the voltage level are cumulative. In each case, the voltage level, current level, and durations may be subject to defined limits depending on the specific system and operating conditions. In one embodiment, both the voltage level and the current level are adjusted by a factor, and the factor can be the same or different for the voltage level and the current level.

In response to the information relating to the corona discharge 22, the duration of time wherein no energy is provided to the corona igniter 20 can also be adjusted by a factor based on the information relating to the corona discharge 22. This factor can be based on the information from one of the corona events, or a plurality of the corona events, and it can be the same or different from the factors used to adjust the voltage and current levels. For example, if the first occurrence of the arc formation is very close to the start time, or if successive arc formations are close together, then the duration of time wherein no energy is provided to the corona igniter 20 is increased by a larger factor.

The system and method of the present invention can optionally include control on an intra-event basis. In this embodiment, the control unit 26 obtains the information relating to the corona discharge 22, including information about the arc formations, during the corona event, and adjusts at least one of the voltage level, current level, and time durations during the same corona event, to increase the quality of the corona discharge 22 during that same corona event. For example, after an arc formation is detected, and after the duration of time wherein no energy is provided to the corona igniter 20, the method includes providing an adjusted energy level to the corona igniter 20 to form a stronger corona discharge 22 and limit the arc formation during the same corona event. If another occurrence of arc formation is detected, the control unit 26 again ceases the energy provided to the corona igniter 20 and adjusts the energy subsequently provided to the corona igniter 20 during the same corona event.

In yet another embodiment, the system and method of the present invention controls the corona discharge 22 on an intra-event and inter-event basis. For example, when the voltage level is adjusted one or more times during a corona event using the intra-event control method, the voltage level at the end of the corona event typically provides a strong corona discharge 22. Thus, the control unit 26 obtains the voltage level at the end of the corona event, and adjusts the predetermined voltage level stored in the map or table level to match it. The adjusted predetermined voltage level is then applied to the corona igniter 20 during at least one subsequent corona event to provide the strong corona discharge 22. The same steps can be conducted to adjust the predetermined current level or duration of time wherein no energy is provided to the corona igniter 20.

Figure 8:
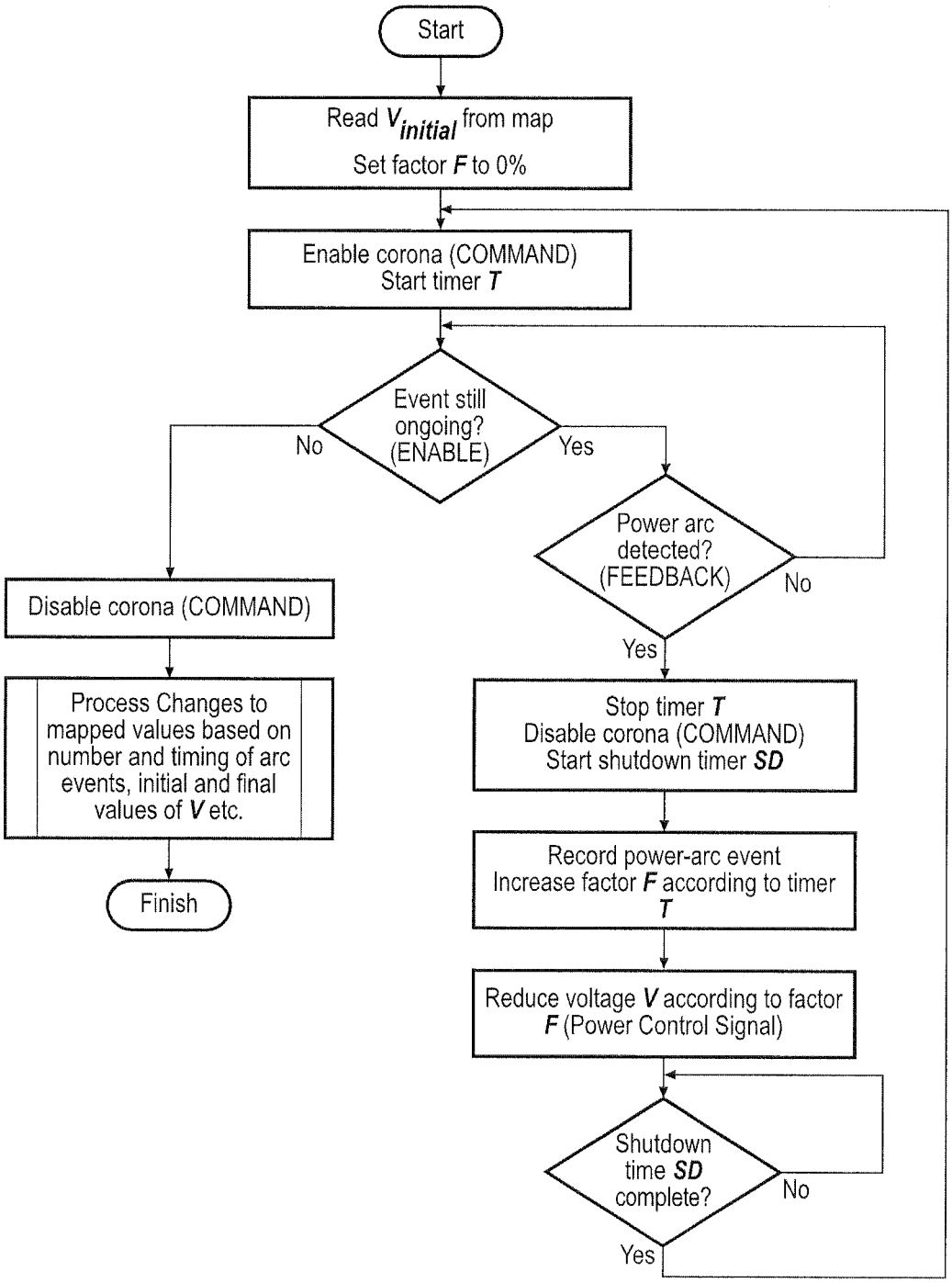
FIG. 8 is a flowchart illustrating a simplified example of method including both inter-event and intra-event voltage control according to one embodiment of the invention.

FIG. 8 is a flow chart illustrating a simplified example of the corona ignition system of the present invention, including the inter-event and optional intra-event control. When the corona event starts, a predetermined voltage level is set. This voltage level is usually read from a table or map of values stored in the control unit 26 or engine control system 24. The predetermined voltage level depends on operating conditions in the combustion chamber 32. In addition, a voltage reduction factor is set to zero, i.e. the voltage level has not yet been reduced.

The control unit 26 sends a command signal 36 to the driver circuit 30 to enable the corona discharge 22, and a timer is started. The timer measures the duration of the active corona discharge 22 before an arc formation is detected. The timer stops when the corona discharge 22 ends, in which case the enable signal 34 from the engine control system 24 ends the corona event, or when arc formation is detected, in which case a feedback signal 46 is transmitted to the control unit 26.

In the system FIG. 8, detection of an arc formation causes an interruption of the energy provided to the corona igniter 20 for a controlled period time, referred to as the shutdown time; and also causes a reduction in the applied voltage level dependent on the duration of corona discharge 22 before arc formation. In addition, information about the number and proximity of any arc formations during the corona event are provided to the control unit 26.

The timer is stopped upon detection of the arc formation, and thus provides the duration of corona discharge 22 before arc formation. The driver circuit 30 may also be turned off using the command signal 36, such that the energy applied to the corona igniter 20 is turned off, and timing of this shutdown begins, referred to as timer shutdown. The duration of the shutdown may be fixed, may be taken from a map depending on operating conditions, or may be adapted according to the arc formations previously detected. The arc formations are recorded for feedback and diagnostic purposes and the factor is modified according to a suitable function, for example as shown in FIG. 7. The function, however, can vary from that shown in FIG. 7, and different function can be used for different arc formations in the same corona event. In addition, the function used to control the factor against time may be different from that used to control the factor against voltage or against current.

The control signal to the power supply 28 instructs the power supply 28 to provide a voltage level reduced according to the factor, subject to externally-set minimum and maximum limits. This reduces the voltage level applied to the corona igniter 20 and hence lowers the voltage obtained at the igniter tip 40 when the driver circuit 30 is re-energized. When the shutdown timer completes, the corona igniter 20 is re-enabled and operation of the corona igniter 20 continues. The enable signal 34 eventually causes the corona discharge 22 to shut off and the inter-event processing takes place, as shown in the left branch of FIG. 8.

Figure 9:
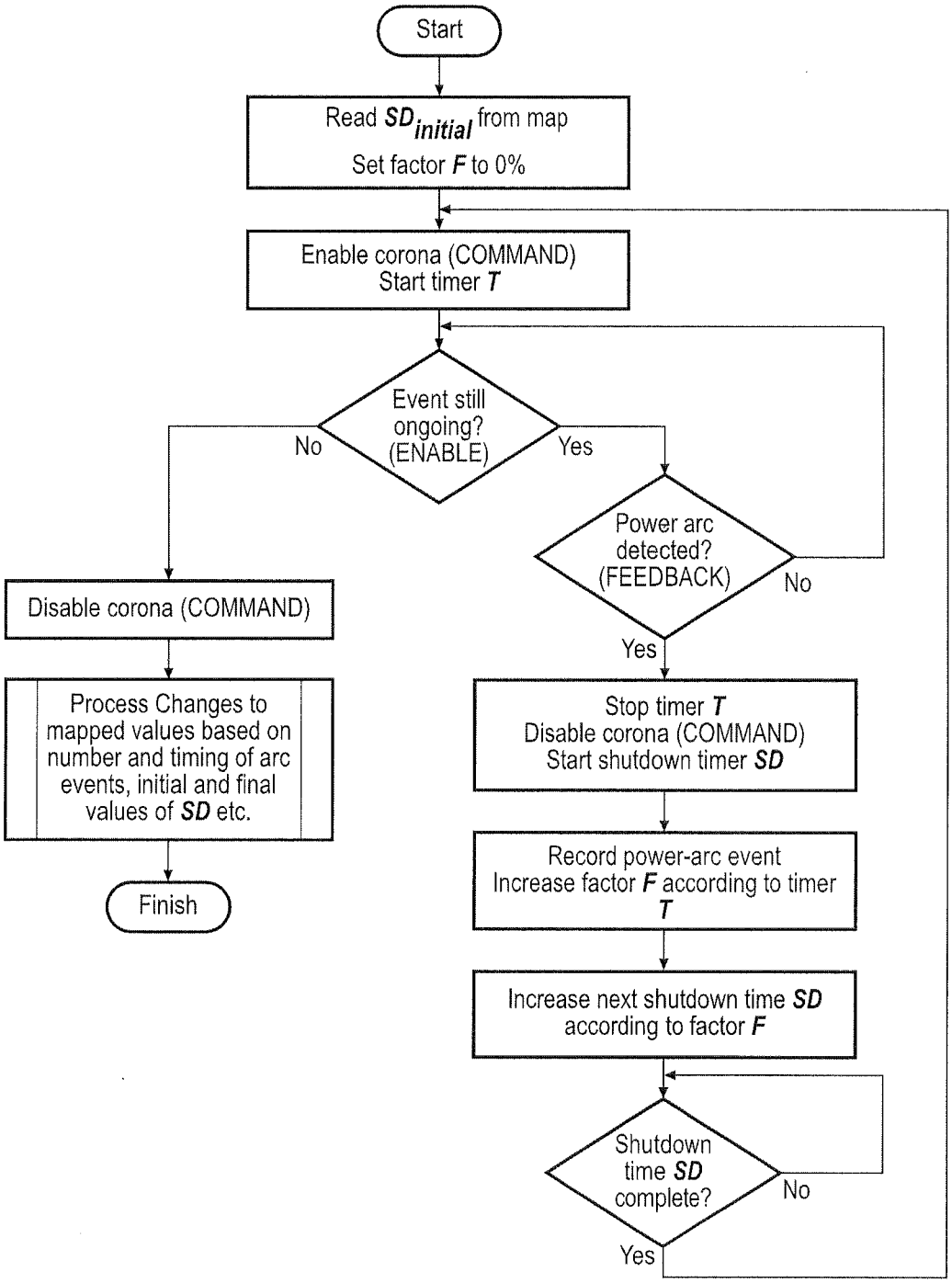
FIG. 9 is a flowchart illustrating another simplified example of a method including both inter-event and intra-event shutdown control according to another embodiment of the invention.

FIG. 9 is a flow chart illustrating another simplified example of the corona ignition system of the present invention, including the inter-event and optional intra-event control. FIG. 9 shows how a similar control strategy may be applied to optimize the shutdown time used to interrupt the corona igniter 20 once the arc formation is detected, in order to allow the arc formation to dissipate and corona discharge 22 to be resumed. The logic of the system is identical to the system of FIG. 8 for voltage control, but in this case, the factor is used to increase the shutdown time. Control of the shutdown time, applied voltage, or of both at the same time, may be applied to optimize the corona discharge 22 on an intra-event timescale.

After the corona event, the final values of voltage level, current level, and/or shutdown time, as well as the recorded number and timing of arc formations detected, are provided to the control unit 26 through the feedback signal 46 and to the engine control system 24 through a feedback interface 48. This data is processed and used to modify the starting values used in the next corona event, as shown in the left branch of FIGS. 8 and 9. Thus, the control unit 26 or engine control system 24 can attempt to produce the optimum pattern of corona discharge 22 and arc formation, such as the pattern shown in FIG. 5. If the voltage level and duration is not reduced during the corona event, this means that no arc formation was detected. Thus, the voltage in the next corona event should be increased in order to favor achievement of the ideal pattern. If the voltage level and/or duration have been greatly reduced, then the voltage level in the next corona event should be reduced to reduce the amount of arc formation. All modifications to voltage level, current level, and duration should be limited by externally defined minima and maxima, which are set depending on the engine and igniter geometry, engine operating conditions, etc.

Obviously, many modifications and variations of the present invention are possible in light of the above teachings and may be practiced otherwise than as specifically described while within the scope of the appended claims.

What is claimed is:

1. A corona ignition system, comprising:

a corona igniter receiving energy and emitting an electric field during a plurality of corona events, wherein each corona event extends continuously from a start time to a stop time;

a driver circuit providing the energy to the corona igniter during the corona events;

the driver circuit detecting any occurrence of an arc formation from the corona igniter and providing no energy to the corona igniter for a predetermined duration of time immediately after any occurrence of the arc formation;

the driver circuit obtaining information about any occurrence of an arc formation during at least one of the corona events, the information including at least one of:

timing of any occurrence of the arc formation relative to the start time of the corona event, duration between two consecutive occurrences of the arc formations, number of occurrences of the arc formations over a period of time during the corona event, timing of an occurrence of the arc formation relative to the stop time of the corona event, total number of occurrences of the arc formations during the corona event, and the voltage level provided to the corona igniter at the stop time of the corona event;

a control unit receiving the information about any occurrence of the arc formation during the one corona event from the driver circuit, and the control unit adjusting the predetermined duration of time wherein no energy is provide to the corona igniter based on the information relating to the corona discharge; and the driver circuit applying the adjusted predetermined duration of time wherein no energy is provide to the corona igniter in at least one subsequent corona event and not before the stop time of the at least one corona event from which the information was obtained.

2. A method of controlling a corona ignition system, comprising the steps of:

providing energy to a corona igniter during a plurality of corona events, wherein each corona event includes a continuous duration of time extending from a start time to a stop time;

detecting any occurrence of an arc formation from the corona igniter during the corona events;

providing no energy to the corona igniter for a predetermined duration of time immediately after any occurrence of the arc formation;

obtaining information relating to the corona discharge of at least one of the corona events, the information including at least one of: timing of any occurrence of an arc formation relative to the start time of the corona event, duration between two consecutive occurrences of the arc formations, number of occurrences of the arc formations over a period of time during the corona event, timing of an occurrence of the arc formation relative to the stop time of the corona event, total number of occurrences of the arc formations during the corona event, and the voltage level provided to the corona igniter at the stop time of the corona event;

adjusting the predetermined duration of time wherein no energy is provided to the corona igniter based on the information relating to the corona discharge; and applying the adjusted predetermined duration of time wherein no energy is provided to the corona igniter during at least one subsequent corona event and not before the stop time of the at least one corona event from which the information was obtained.

3. The method of claim 2 wherein the corona igniter emits a corona discharge prior to a first occurrence of the arc formation;

the step of providing no energy to the corona igniter includes dissipating the arc formation; and including the step of:

providing energy to the corona igniter to resume the corona discharge immediately after the duration of time wherein no energy is provided to the corona igniter.

4. The method of claim 2 including the step of storing the predetermined duration of time wherein no energy is provided to the corona igniter; and the adjusting step including adjusting the stored predetermined duration of time.

5. The method of claim 2 including adjusting the predetermined duration of time based on the information obtained from a plurality of the corona events.

6. The method of claim 2 including increasing the predetermined duration of time wherein no energy is provided to the corona igniter by a factor based on the information relating to the corona discharge.

7. The method of claim 2 including increasing at least one of the volume and the duration of the corona discharge during the at least one subsequent corona event as a result of the adjusting step.

8. The method of claim 2 wherein the step of detecting the occurrence of the arc formation includes identifying a variation in an oscillation period of the resonant frequency of the corona igniter.

9. The method of claim 2 wherein each corona event includes the steps of:

conveying a command signal from a control unit to a driver circuit to activate the driver circuit;

conveying a power control signal from the control unit to a power supply in response to the enable signal;

conveying energy from the power supply to the driver circuit in response to the power control signal;

the step of providing the energy to the corona igniter including conveying energy from the driver circuit to the corona igniter in response to the command signal so that the corona igniter provides corona discharge;

the step of detecting any occurrence of an arc formation and the step of obtaining the information about the arc formation being conducted by the driver circuit;

conveying a feedback signal from the driver circuit to the control unit during the corona event, wherein the feedback signal indicates the occurrence of the arc formation;

conveying a command signal from the control unit to the driver circuit instructing the driver circuit to provide no energy to the corona igniter for the duration of time in response to the feedback signal;

conveying a feedback signal from the driver circuit to the control unit with the information relating to the corona discharge;

providing the energy to the corona igniter during at least one subsequent corona event and applying the adjusted predetermined duration of time wherein no energy is provided to the corona igniter during the at least one subsequent corona event.

10. The method of claim 2 including obtaining the information relating to the corona discharge and adjusting at least one of the voltage level, the current level, the duration of time wherein no energy is provided to the corona igniter, and the duration of the corona event during at least one of the one corona events based on the information relating to the corona discharge.

* * * * *